US006609714B1

(12) United States Patent
Becker

(10) Patent No.: US 6,609,714 B1
(45) Date of Patent: Aug. 26, 2003

(54) SHIP, CAPTAIN AND CREW, A CARD GAME

(75) Inventor: Kathleen A. Becker, 4860 Knott La., Crandon, WI (US) 54520

(73) Assignee: Kathleen A. Becker, Crandon, WI (US)

( * ) Notice: Subject to any disclaimer, the term of this patent is extended or adjusted under 35 U.S.C. 154(b) by 0 days.

(21) Appl. No.: 10/095,952

(22) Filed: Mar. 11, 2002

(51) Int. Cl.[7] ..... A63F 1/00
(52) U.S. Cl. ..... 273/308; 273/292
(58) Field of Search ..... 273/307, 308, 273/292

(56) References Cited

U.S. PATENT DOCUMENTS 5,374,067 A * 12/1994 Jones ..... 273/292
6,209,875 B1 * 4/2001 Vildosola ..... 273/302
6,247,697 B1 * 6/2001 Jewett ..... 273/292

* cited by examiner

*Primary Examiner*—Benjamin H. Layno
*Assistant Examiner*—Vishu Mendiratta

(57) ABSTRACT

An indicia card game containing four different colored decks. Each deck contains 20 cards: one graphic ship card, one graphic captain card, 12 graphic crew cards numbered 1 through 12, and six zero cards. The first player to accumulate one ship card, one captain card, and the highest numeric crew card becomes the winner of that round. A total of 50 points, or optional limit, is required to become the winner of the entire game. By varying each played round with different colored decks of dealt cards, eliminating the zero cards, if so desired for faster play, taking a chance of discarding a low numeric crew card for a higher one, coupled with accumulating double or triple points, if a tie occurs, totally enhances the game. Young children have the option of playing drawn cards face-up thereby improving their skills in arithmetic without the use of a calculator.

1 Claim, 6 Drawing Sheets

(Fig. 1)
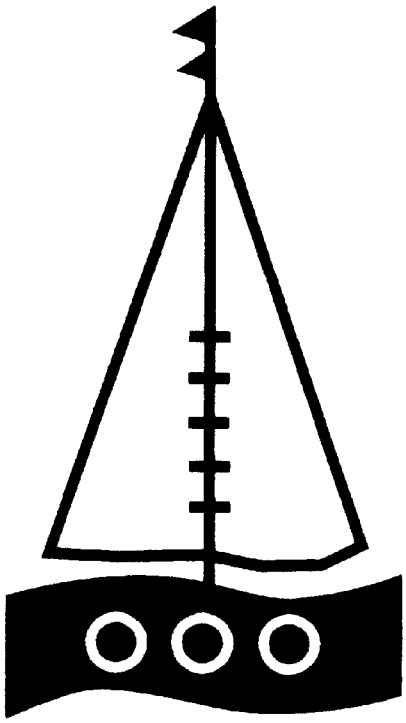
Ship Card (Fig. 2)
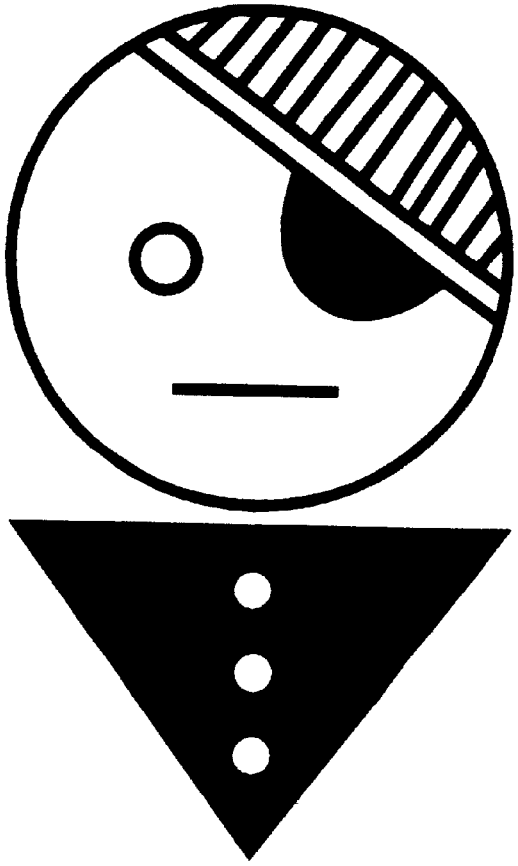
Captain Card (Fig. 3)
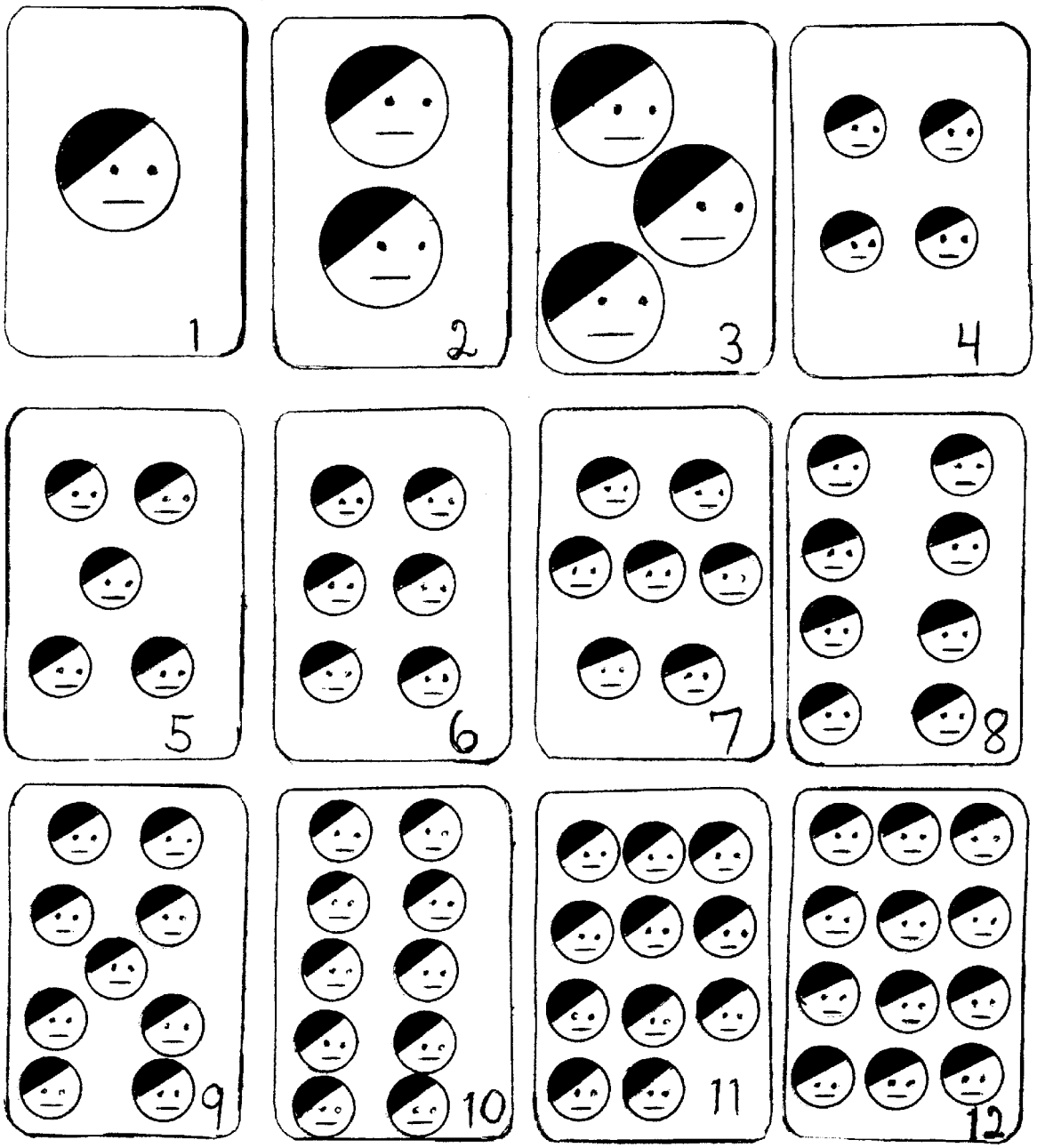
Crew Cards (Fig. 4)
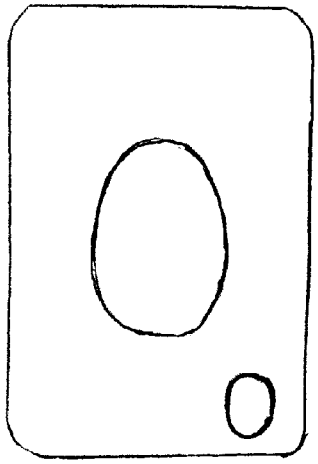
Zero Card (Fig. 5)
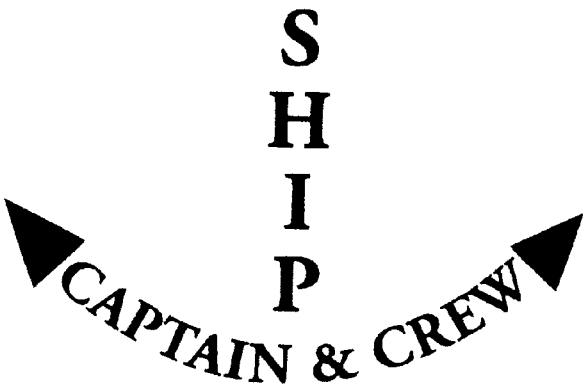
Front of Cards (Fig. 6)
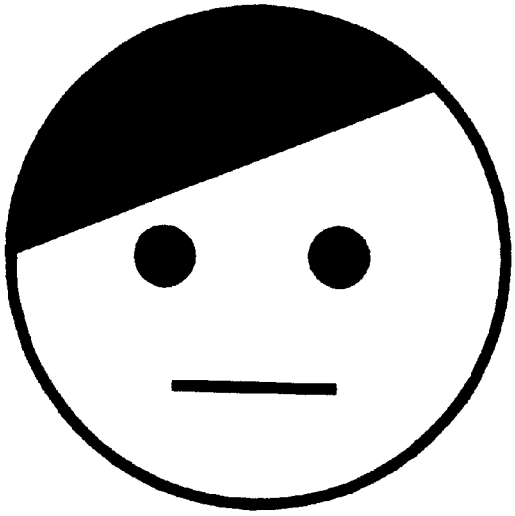
Enlarged Crew Card Graphic

SHIP, CAPTAIN AND CREW, A CARD GAME

BACKGROUND

There is a need for a card game which teaches a young child how to count and add numbers while still providing an amount of amusement and entertainment. This card game will provide that skill without being too time consuming or difficult to understand. It will also enhance a child's ability to learn basic arithmetic without the use of a calculator or a computer.

SUMMARY

A card game titled Ship, Captain & Crew is played with a minimum of two players and a maximum of four players. It is for children that are four years or older and contains four specifically designed decks of cards. The first player to accumulate one ship card, one captain card, and the highest numeric crew card is the winner of that round. The first player to accumulate a total of 50 points (or optional limit) becomes the winner of the entire game.

DRAWING FIGURES (FIG. 1) shows the graphic design of the Ship card, (FIG. 2) shows the graphic design of the captain card, (FIG. 3) shows the 12 graphic designs of the crew cards, (FIG. 4) shows the graphic design of the zero cards, (FIG. 5) shows the graphic design that will appear on the front of each card and (FIG. 6) shows the enlarged graphic of the crew cards.

DESCRIPTION

1. Each deck has a different background patina consisting of my chosen colors of: turquoise blue, luminous yellow, iridescent orange, and lime green.
2. All graphics and numerals are printed in black color on the individual card and each deck contains 20 cards: one graphic ship card (FIG. 1), one graphic captain card (FIG. 2), 12 graphic crew cards numbered 1 through 12 (FIG. 3), and six zero cards (FIG. 4).
3. Each deck card measures 2½" × 3½" in size and will be plastic coated. Examples shown in drawings are larger or smaller than what will appear on the actual card since the game has not been professionally printed at this point in time. Each deck contains 20 cards, with four decks per package; therefore, the marketed game will contain a total of 80 cards.

OPERATION

1. To determine who goes first, shuffle one complete deck of the same color cards and have each player draw oe card from that deck. The player with the highest number crew card goes first.
2. To begin the game each player shuffles a deck of the same color cards. He then takes that shuffled deck and places it face down in front of the player to his left.
3. The first player draws three cards from the face down deck which has been placed in front of him. The second play then draws three cards from the deck of cards in front of him and then the next player. The three drawn cards are always held close to the person without the other players viewing them.
   a. When all players have three cards in their hand, any player that has a ship card, a captain card, and a number crew card can lay down his cards (face up) - when it is his turn thereby becoming the winner of this round.

-continued b. After discarding cards (maximum of 3) and after drawing cards (maximum of 3) - you must wait your turn - to lay down if you have winning cards. The play continues to the left.
   c. If a double winner is produced by two players having the same number value of a crew card, along with their ship and captain card in a round, creating a tie, a second round must be played. If two players tie, then everyone ties and all players play again.
   d. The decks are shuffled again. The play always continues to the left.
   e. When playing due to a double winner in a round, the winner of this next round will receive double points. If there is another tie, a third round must be played and the winner of that third round will receive triple points. Play resumes.
   f. Decks are always shuffled after every winning round. The winner of the last round goes first when a new round begins. Three cards must be kept in your hand at all times. All discarded cards are placed face down away from the main playing area.
   g. The winner of each round must write down the number value of the crew card on his individual piece of paper. As the rounds progress, each player must add his own points until 50 is reached, (or optional limit) thereby becoming the final winner of the game.
   h. Playing Tip: Thoroughly shuffle your deck because it is always passed to the player on the left when a new round begins.
   i. Playing Variation for Younger Children: The three drawn cards may be placed face up.
   j. For Faster Play: Remove the 6 cards of "0" each deck, thereby playing with only 14 cards in each deck.

What is claimed is:

1. A method of playing an indicia card game for children titled Ship, Captain, & Crew comprising the steps of:

providing four different colored decks of cards with 20 cards in each deck, containing one ship card, one captain card, 12 crew cards numbered 1 through 12, and six zero cards, requiring a minimum of two players and a maximum of four with the first player to accumulate one ship card, one captain card, and the highest numeric crew card becoming the winner of that round and requiring 50 points, or optional limit, to become the winner of the entire game;

wherein each round is varied because;

players are always dealt a different colored deck of cards which are placed face down in front of the player to their left with the first player drawing three cards from the face down deck in front of that player and then the second player drawing three cards from their face down cards until all players have three cards in their hands at which point any player that has a ship card, a captain card, and a numeric crew card can lay down their cards, when it is their turn, thereby becoming the winner of that round;

wherein after discarding cards;

maximum of 3 allowed, and after drawing cards, maximum of 3 allowed, the player must wait their turn to lay down if they have winning cards and play continues to the left;

wherein if a double winner is produced;

the two players having the same numeric value of a crew card, along with their ship and captain card in a round, thus creating a tie, a second round must be played, because if two players tie, then everyone ties and all players must play again;

whereby decks are shuffled again and the play always continues to the left;

and when playing due to a double winner, the winner of this next round receives double points, and if there is another tie, a third round must be played and the winner of this third round receives triple points;

said decks are always shuffled after every winning round with the winner of the last round going first when a new round begins requiring that;

said three cards be kept in a player's hand at all times and all discarded cards be placed face down away from the main playing area and all winners must write down the numeric value of their winning crew card and tally their own points until 50 is reached, or optional limit;

wherein to vary the play for younger children;

the three drawn cards may be played face up thereby encouraging the recognition of numbers;

wherein for faster play with older children;

the six cards of zero can be removed from each deck thereby playing with only 14 cards in each deck and taking the strategy of discarding a low numeric crew card for a higher one to enhance the player's final score.

* * * * *